US007610634B2

(12) United States Patent
Kondo

(10) Patent No.: US 7,610,634 B2
(45) Date of Patent: Nov. 3, 2009

(54) BATHTUB DEVICE

(75) Inventor: Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 747 days.

(21) Appl. No.: 11/235,197

(22) Filed: Sep. 27, 2005

(65) Prior Publication Data

US 2006/0070176 A1 Apr. 6, 2006

(30) Foreign Application Priority Data

Oct. 6, 2004 (JP) ..... 2004-294176

(51) Int. Cl.
*A47K 3/06* (2006.01)

(52) U.S. Cl. ..... 4/585; 4/584; 4/538

(58) Field of Classification Search ..... 4/538, 4/566.1, 564.1, 565.1, 495, 560.1, 584, 585, 4/588, 592, 593

See application file for complete search history.

(56) References Cited

U.S. PATENT DOCUMENTS 5,036,555 A * 8/1991 Oudt ..... 4/495
6,363,545 B1 * 4/2002 Nowosad ..... 4/566.1

FOREIGN PATENT DOCUMENTS

JP 05199946 A * 8/1993

* cited by examiner

*Primary Examiner*—Huyen Le
(74) *Attorney, Agent, or Firm*—Oblon, Spivak, McClelland, Maier & Neustadt, L.L.P.

(57) ABSTRACT

A bathtub device includes a bathtub internal wall made of a flexible material, a pressure unit for changing a shape of a tub, which is a concavity surrounded with the internal wall, by applying a pressure on the internal wall, a setting unit for setting a movement range that is a changeable range of the shape of the tub, and a pressure control unit for controlling the pressure unit based on an operation entry by a user and the movement range.

15 Claims, 11 Drawing Sheets

BATHTUB DEVICE

CROSS REFERENCES TO RELATED APPLICATIONS

The present invention contains subject matter related to Japanese Patent Application JP 2004-294176 filed in the Japanese Patent Office on Oct. 06, 2004, the entire contents of which are incorporated herein by reference.

BACKGROUND OF THE INVENTION

1. Field of the Invention

The present invention relates to bathtub devices, and in particular it relates to a bathtub device in that a user can take a comfortable bath by making a bathtub shape variable.

2. Description of the Related Art

Bathtubs with various shapes and sizes have been proposed. Bathtubs having a shape in consideration of the bathing of persons who need care have been also proposed (Japanese Unexamined Patent Application Publication No. 2003-325631, for example).

However, since conventional bathtubs are fixed in size, while the size is suitable for a certain person, for other persons, it may be too long, short, shallow, or deep.

SUMMARY OF THE INVENTION

The present invention has been made in view of such a situation, and it is desirable to provide a bathtub device in that a user can take a comfortable bath by making a bathtub shape variable.

A bathtub device according to an embodiment of the present invention includes a bathtub internal wall made of a flexible material; a pressure unit for changing a shape of a tub, which is a concavity surrounded with the internal wall, by applying a pressure on the internal wall; a setting unit for setting a movement range that is a changeable range of the shape of the tub; and a pressure control unit for controlling the pressure unit based on an operation entry by a user and the movement range.

The bathtub device may further include a bottom surface area detector for detecting the bottom surface area of the tub; and a water amount detector for detecting the water amount contained in the tub based on the bottom surface area of the tub, and the setting unit may establish the movement range on the basis of the bottom surface area of the tub and the water amount contained in the tub.

Preferably, the pressure control unit changes the shape of the tub within the movement range of the tub by controlling the pressure unit to apply a pressure on the internal wall as long as the operation entry by a user continues.

Preferably, the setting unit establishes the movement range on the basis of one or more of the body height, the shoulder width, the hip width, the seated height, the face length, the body volume, and the body weight of a user.

A bathtub device according to an embodiment of the present invention includes internal wall means constituting a bathtub internal wall and made of a flexible material; pressurizing means for changing a shape of tub means, which is a concavity surrounded with the internal wall means, by applying a pressure on the internal wall means; setting means for setting a movement range that is a changeable range of the shape of the tub means; and pressure controlling means for controlling the pressurizing means based on an operation entry by a user and the movement range.

DESCRIPTION OF THE PREFERRED EMBODIMENTS

Embodiments of the present invention will be described below with reference to the drawings.

Figure 1:
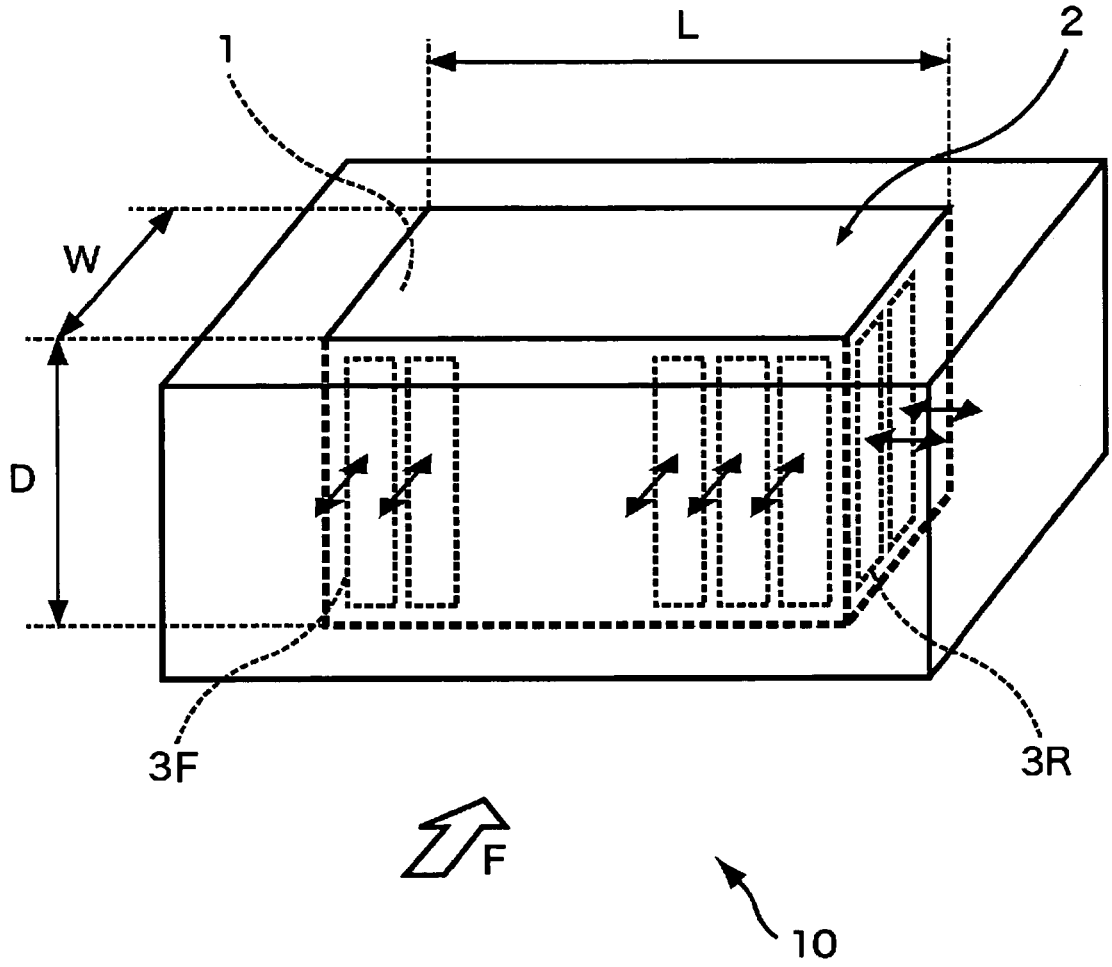
FIG. 1 is a perspective view of a structure of a bathtub device according to an embodiment of the present invention.
Figure 2:
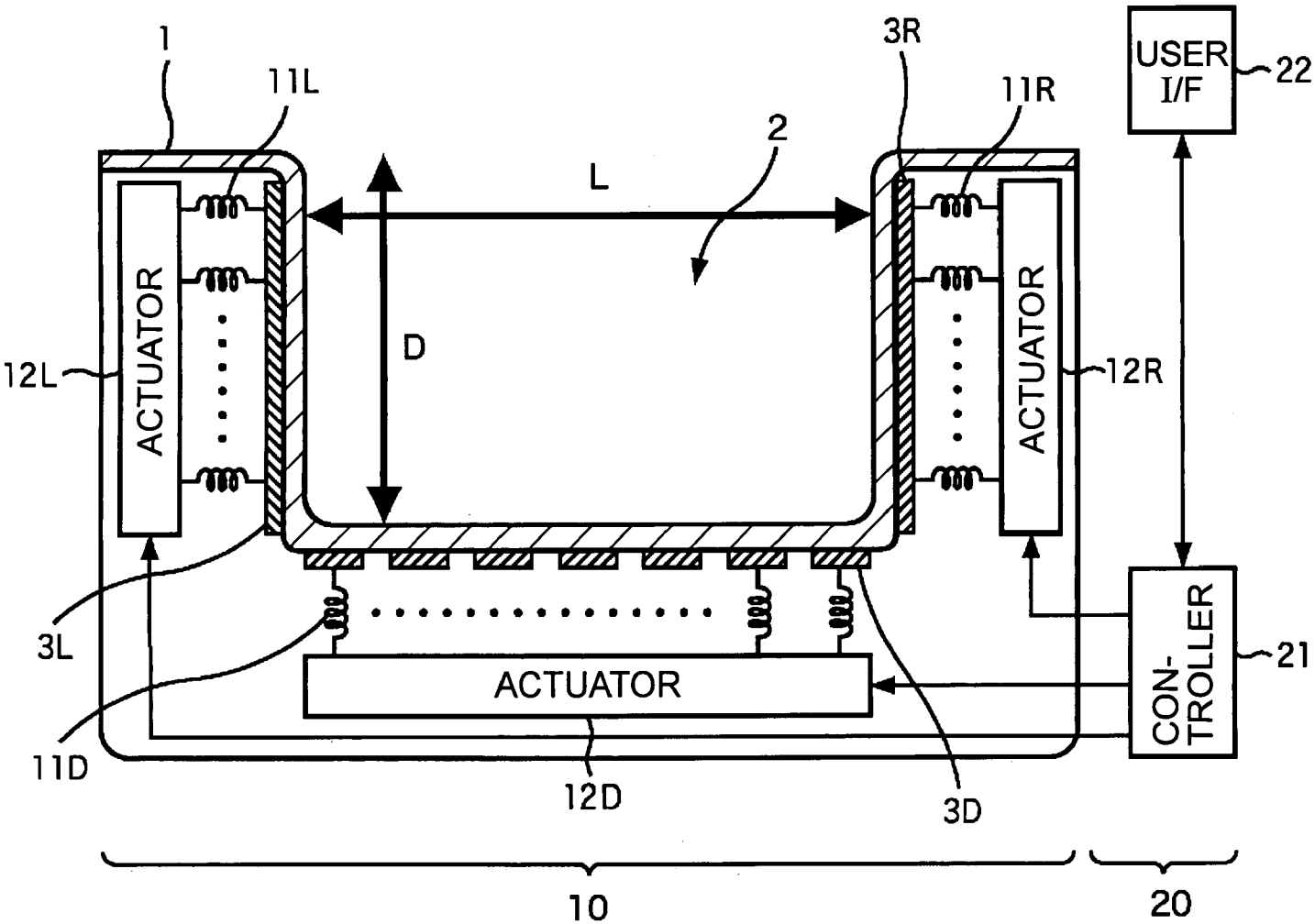
FIG. 2 is a sectional view of the bathtub device viewed from the front.
Figure 3:
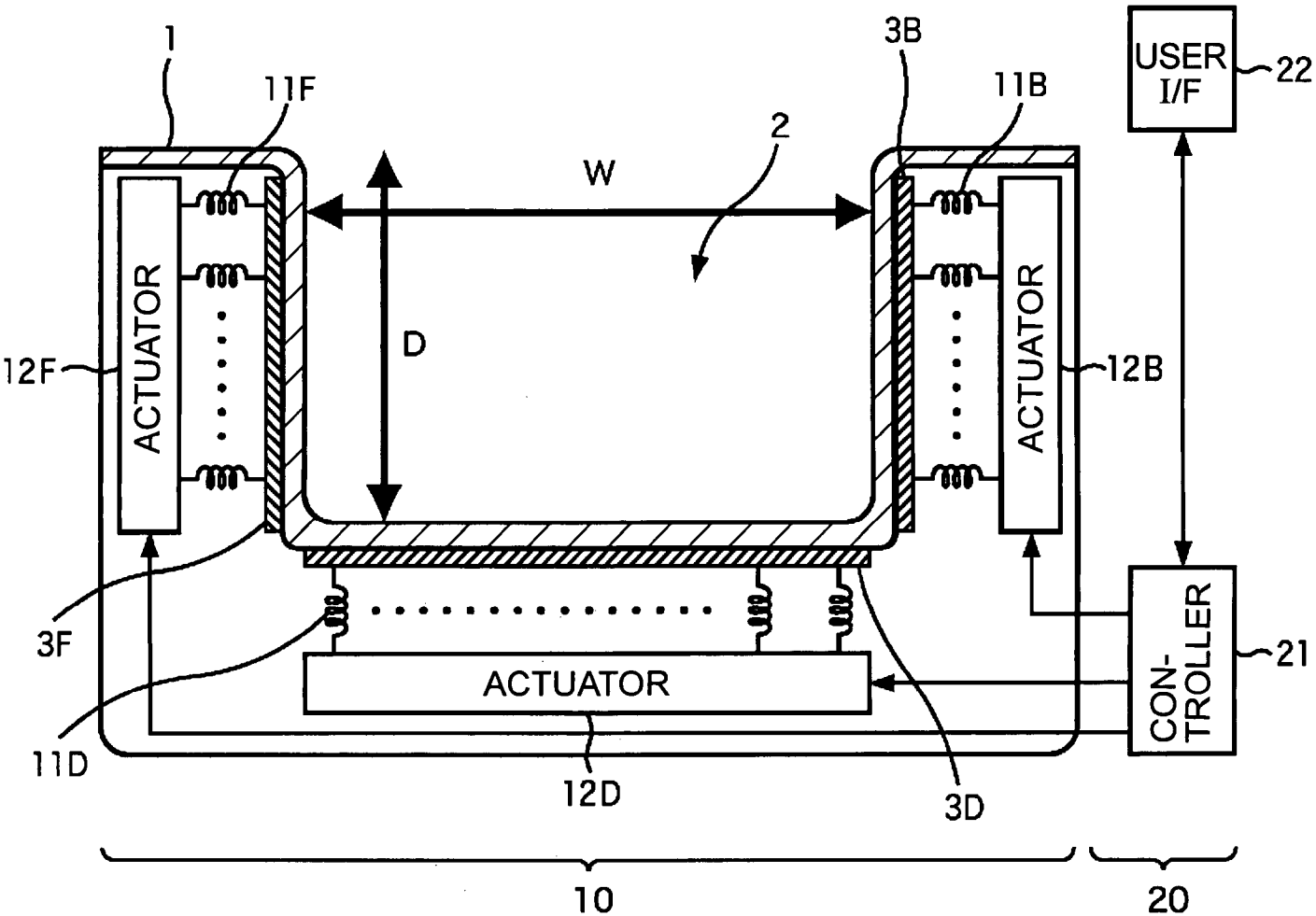
FIG. 3 is a sectional view of the bathtub device viewed from the right side.

FIGS. 1 to 3 show a structure of a bathtub device according to an embodiment of the present invention.

The bathtub device is composed of a bathtub 10 and a bathtub controller 20 for controlling the bathtub 10. FIG. 1 is a perspective view of the bathtub 10; FIG. 2 is a sectional view of the bathtub 10 viewed in the front direction indicated by arrow F of FIG. 1; and FIG. 3 is a sectional view of the bathtub 10 viewed from the right side.

A bathtub 10 has a nearly rectangular parallelepiped shape, and an internal wall 1 of the bathtub 10 is made of a flexible material. The internal wall 1 constitutes a tub 2 which is a concave space. That is, the tub 2 is a concave space surrounded by the internal wall 1, and a user takes a bath by pouring hot water into the tub 2.

The tub 2 is a nearly rectangular parallelepiped space, and its front, rear, left side, right side, and bottom surfaces are surrounded with the internal wall 1. The internal wall 1, as mentioned above, is made of a flexible material, so that the tub 2 can be changed in length L, width W, or depth D by moving the respective surfaces of the internal wall 1 adjacent to the front, rear, left side, right side, and bottom surfaces of the tub 2.

That is, on a surface of the internal wall 1 opposite to the front of the tub 2, a plurality of support panels 3F are provided (FIGS. 1 and 3). The respective support panels 3F are a nearly rectangular flat plate longitudinally directed in parallel to the direction of the depth D, and are arranged at predetermined intervals in the direction of the length L so as to support the internal wall surface on the front side of the tub 2.

Furthermore, on surfaces of the respective support panels 3F opposite to the internal wall 1, elastic cushioning units 11F (FIG. 3) are provided. Each of the cushioning units 11F is provided with an actuator 12F (FIG. 3) arranged opposite to the support panel 3F.

The actuator 12F is configured by a motor, for example, and applies a pressure (pushing pressure or drawing pressure) in the width W direction to the cushioning unit 11F. By applying the pressure to the cushioning units 11F, the plurality of support panels 3F are pressurized, and furthermore, the surfaces of the internal wall 1 supported by the plurality of support panels 3F are pressurized. As a result, the surface of the internal wall 1 having the pressure applied thereon moves in the width W direction due to its flexibility, so that the shape of the tub 2, i.e., the size in width W of the tub 2 at this time, is changed.

Also, on a surface of the internal wall 1 opposite to the rear of the tub 2, a plurality of support panels 3B (FIG. 3) are provided in the same way as in the front of the tub 2. The respective support panels 3B are a nearly rectangular flat plate longitudinally directed in parallel to the direction of the depth D, and are arranged at predetermined intervals in the direction of the length L, in the similar way to that of the support panel 3F, so as to support the internal wall surface on the front side of the tub 2.

Furthermore, on surfaces of the respective support panels 3B opposite to the internal wall 1, elastic cushioning units 11B (FIG. 3) are provided. Each of the cushioning units 11B is provided with an actuator 12B (FIG. 3) arranged opposite to the support panel 3B.

The actuator 12B is configured by a motor, for example, and applies a pressure (pushing pressure or drawing pressure) in the width W direction to the cushioning unit 11B. By applying the pressure to the cushioning units 11B, the plurality of support panels 3B are pressurized, and furthermore, the surfaces of the internal wall 1 supported by the plurality of support panels 3B are pressurized. As a result, the surface of the internal wall 1 having the pressure applied thereon moves in the width W direction due to its flexibility, so that the shape of the tub 2, i.e., the size in width W of the tub 2 at this time, is changed.

Also, on a surface of the internal wall 1 opposite to the right side of the tub 2, a plurality of support panels 3R (FIGS. 1 and 2) are provided. The respective support panels 3R are a nearly rectangular flat plate longitudinally directed in parallel to the direction of the depth D, and are arranged at predetermined intervals in the direction of the length L so as to support the internal wall surface on the right side of the tub 2.

Furthermore, on surfaces of the respective support panels 3R opposite to the internal wall 1, elastic cushioning units 11R (FIG. 2) are provided. Each of the cushioning units 11R is provided with an actuator 12R (FIG. 2) arranged opposite to the support panel 3R.

The actuator 12R is configured by a motor, for example, and applies a pressure (pushing pressure or drawing pressure) in the length L direction to the cushioning unit 11R. By applying the pressure to the cushioning units 11R, the plurality of support panels 3R are pressurized, and furthermore, the surfaces of the internal wall 1 supported by the plurality of support panels 3R are pressurized. As a result, the surface of the internal wall 1 having the pressure applied thereon moves in the length L direction due to its flexibility, so that the shape of the tub 2, i.e., the size in length L of the tub 2 at this time, is changed.

Also, on a surface of the internal wall 1 opposite to the left side of the tub 2, a plurality of support panels 3L (FIG. 2) are provided. The respective support panels 3L are a nearly rectangular flat plate longitudinally directed in parallel to the direction of the depth D, and are arranged at predetermined intervals in the direction of the width W, in the similar way to that of the support panel 3R, so as to support the internal wall surface on the left side of the tub 2.

Furthermore, on surfaces of the respective support panels 3L opposite to the internal wall 1, elastic cushioning units 11L (FIG. 2) are provided. Each of the cushioning units 11L is provided with an actuator 12L (FIG. 2) arranged opposite to the support panel 3L.

The actuator 12L is configured by a motor, for example, and applies a pressure (pushing pressure or drawing pressure) in the length L direction to the cushioning unit 11L. By applying the pressure to the cushioning units 11L, the plurality of support panels 3L are pressurized, and furthermore, the surfaces of the internal wall 1 supported by the plurality of support panels 3L are pressurized. As a result, the surface of the internal wall 1 having the pressure applied thereon moves in the length L direction due to its flexibility, so that the shape of the tub 2, i.e., the size in length L of the tub 2 at this time, is changed.

Also, on a surface of the internal wall 1 opposite to the bottom surface side of the tub 2, a plurality of support panels 3D (FIGS. 2 and 3) are provided. The respective support panels 3D are a nearly rectangular flat plate longitudinally directed in parallel to the direction of the width W, and are arranged at predetermined intervals in the direction of the length L so as to support the internal wall surface on the bottom surface side of the tub 2.

Furthermore, on surfaces of the respective support panels 3D opposite to the internal wall 1, elastic cushioning units 11D (FIGS. 2 and 3) are provided. Each of the cushioning units 11D is provided with an actuator 12D (FIGS. 2 and 3) arranged opposite to the support panel 3D.

The actuator 12D is configured by a motor, for example, and applies a pressure (pushing pressure or drawing pressure) in the depth D direction to the cushioning unit 11D. By applying the pressure to the cushioning units 11D, the plurality of support panels 3D are pressurized, and furthermore, the surfaces of the internal wall 1 supported by the plurality of support panels 3D are pressurized. As a result, the surface of the internal wall 1 having the pressure applied thereon moves in the depth D direction due to its flexibility, so that the shape of the tub 2, i.e., the size in depth D of the tub 2 at this time, is changed.

The actuators 12F, 12B, 12L, 12R, and 12D of the bathtub 10 are controlled by a controller 21 constituting a bathtub control unit 20 (FIGS. 2 and 3).

That is, the bathtub control unit 20 includes the controller 21 and a user I/F (interface) 22.

The controller 21 controls the actuators 12F, 12B, 12L, 12R, and 12D based on an operation signal fed from the user I/F 22.

The user I/F 22 includes an operation unit used by a user for inputting various entries and a display for presenting various pieces of information to the user (any of these is not shown). For example, when the user operates the user I/F 22, the operation signal corresponding to this operation is supplied to the controller 21. The information presented in the display of the user I/F 22 includes the temperature and the amount of hot water in the tub 2, for example.

In the bathtub device configured as described above, when a user operates the user I/F 22, the operation signal corresponding to this operation is supplied to the controller 21. The controller 21 controls the actuators 12F, 12B, 12L, 12R, and 12D based on an operation signal fed from the user I/F 22 so as to change the shape of the tub 2.

That is, FIGS. 4 to 6 show the bathtub 10 in a state of the tub 2 changed in shape.

Figure 4A:
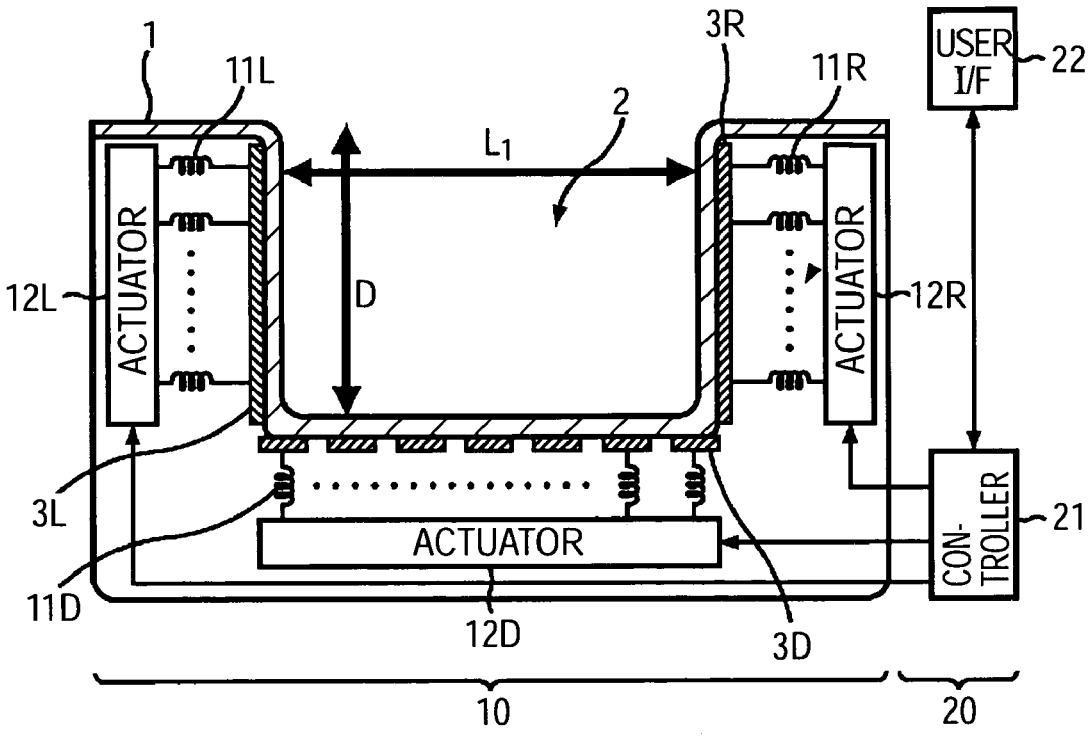
FIG. 4A is a sectional view of a bathtub 10, in which the shape of a tub 2 is changed in a length direction, viewed from the front.
Figure 4B:
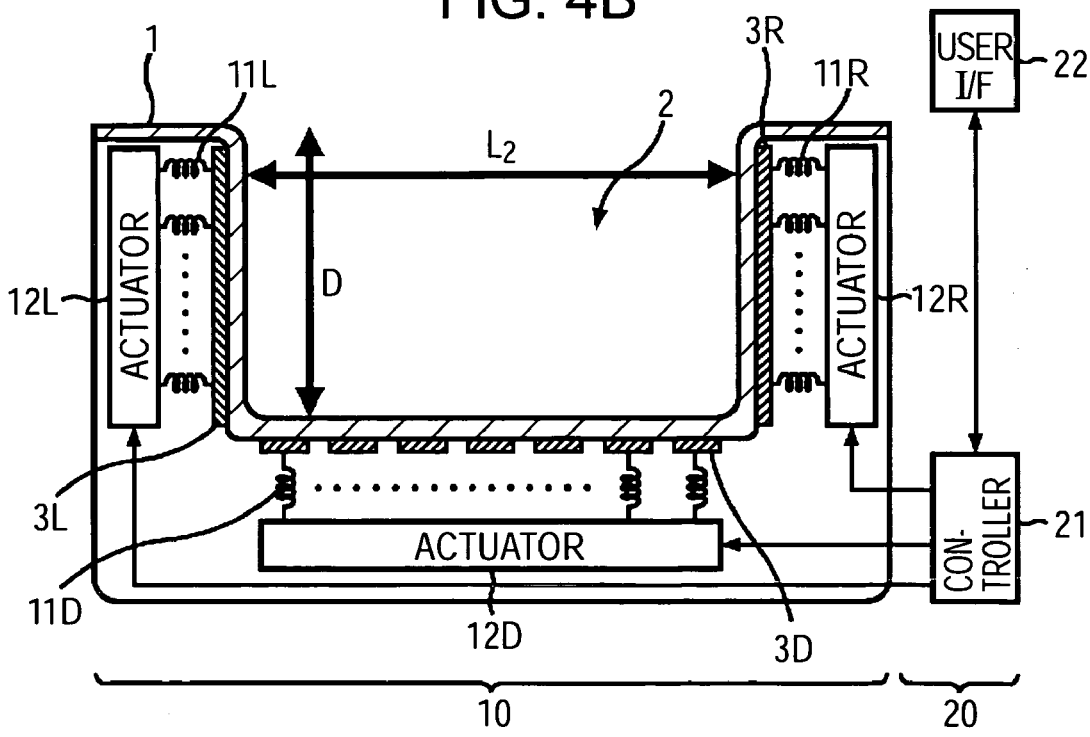
FIG. 4B is another sectional view of the bathtub 10, in which the shape of the tub 2 is changed in the length direction, viewed from the front.

First, FIGS. 4A and 4B show the bathtub 10 in a state of the tub 2 changed in length L. FIGS. 4A and 4B are sectional views similar to FIG. 2.

When pushing pressures are applied by the actuators 12L and 12R to the surfaces of the internal wall 1 supported by the support panels 3L and 3R, respectively, the surfaces having the pressures applied thereon move inside the bathtub 10, so that the length L of the tub 2 is reduced as shown in FIG. 4A. In FIG. 4A, the length L becomes L1.

When drawing pressures are applied by the actuators 12L and 12R to the surfaces of the internal wall 1 supported by the support panels 3L and 3R, respectively, the surfaces having the pressures applied thereon move outside the bathtub 10, so that the length L of the tub 2 is increased as shown in FIG. 4B. In FIG. 4B, the length L becomes L2 (>L1).

Figure 5A:
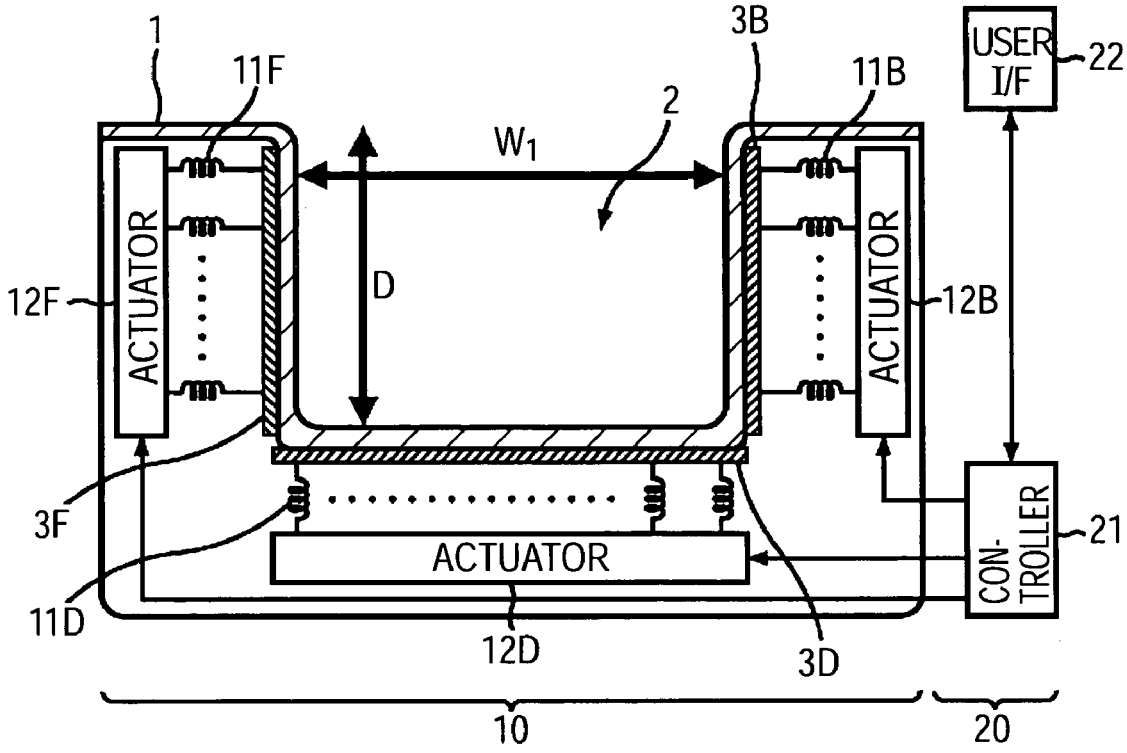
FIG. 5A is a sectional view of the bathtub 10, in which the shape of the tub 2 is changed in a width direction, viewed from the right side.
Figure 5B:
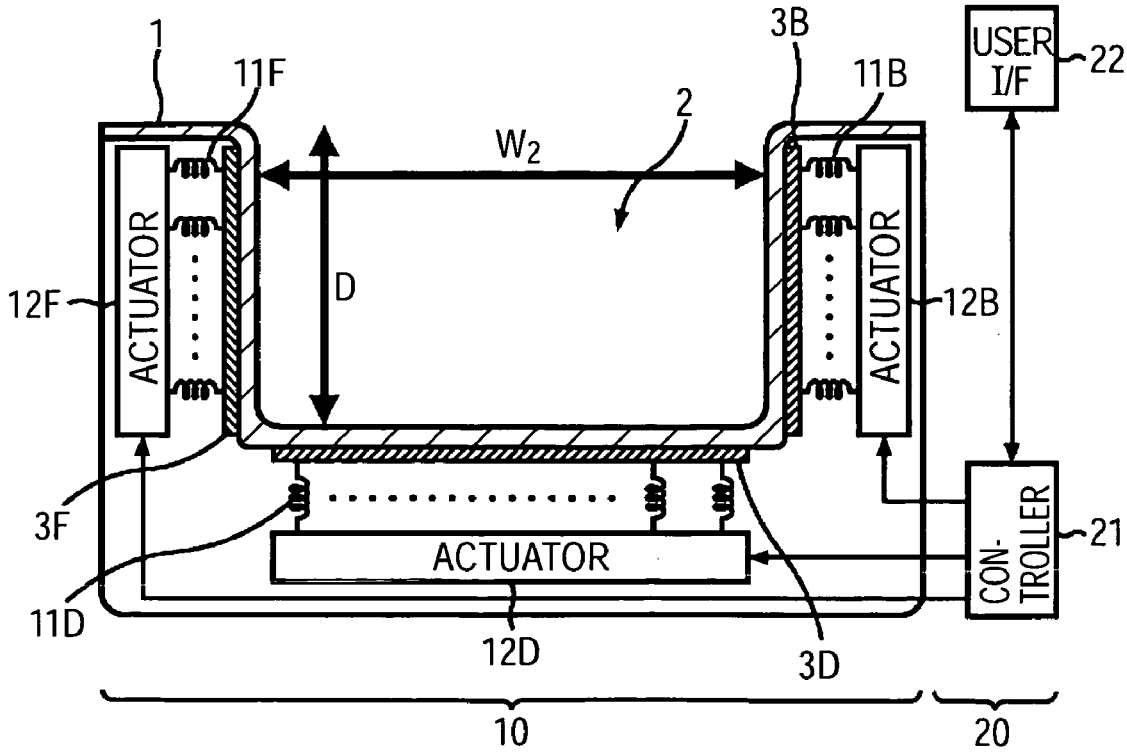
FIG. 5B is another sectional view of the bathtub 10, in which the shape of the tub 2 is changed in the width direction, viewed from the right side.

Next, FIGS. 5A and 5B show the bathtub 10 in a state of the tub 2 changed in width W. FIGS. 5A and 5B are sectional views similar to FIG. 3.

When pushing pressures are applied by the actuators 12F and 12B to the surfaces of the internal wall 1 supported by the support panels 3F and 3B, respectively, the surfaces having the pressures applied thereon move inside the bathtub 10, so that the width W of the tub 2 is reduced as shown in FIG. 5A. In FIG. 5A, the width W becomes W1.

When drawing pressures are applied by the actuators 12F and 12B to the surfaces of the internal wall 1 supported by the support panels 3F and 3B, respectively, the surfaces having the pressures applied thereon move outside the bathtub 10, so that the width W of the tub 2 is increased as shown in FIG. 5B. In FIG. 5B, the width W becomes W2 (>W1).

Figure 6A:
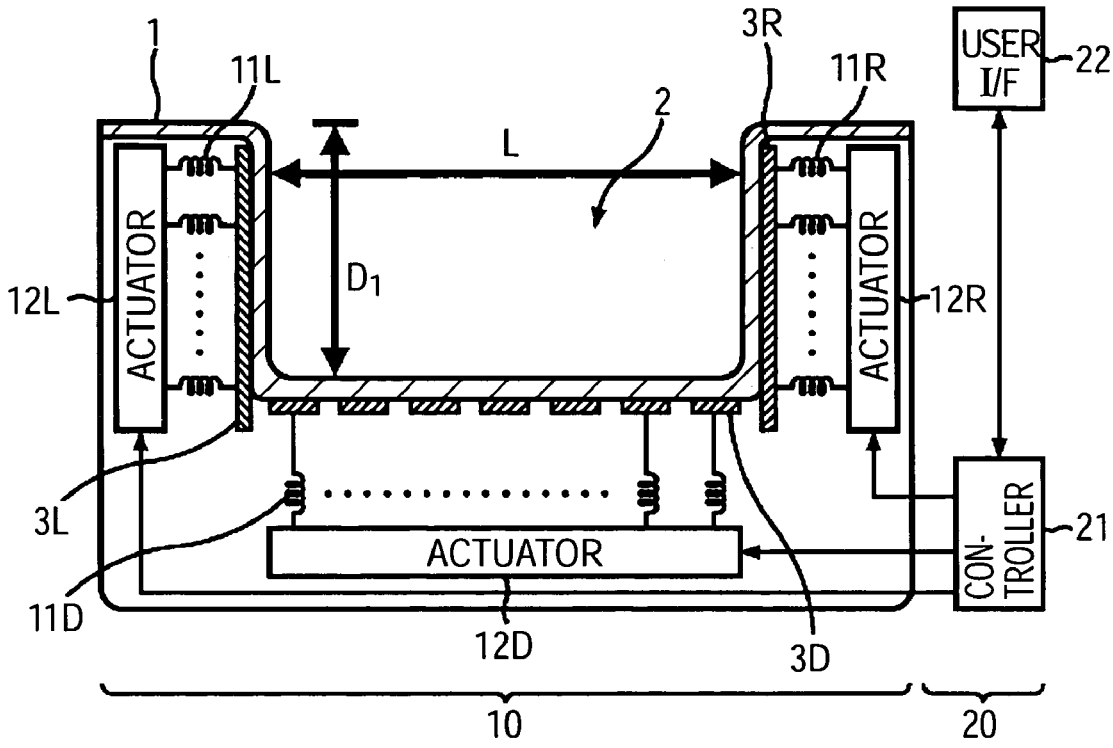
FIG. 6A is a sectional view of the bathtub 10, in which the shape of the tub 2 is changed in a depth direction, viewed from the front.
Figure 6B:
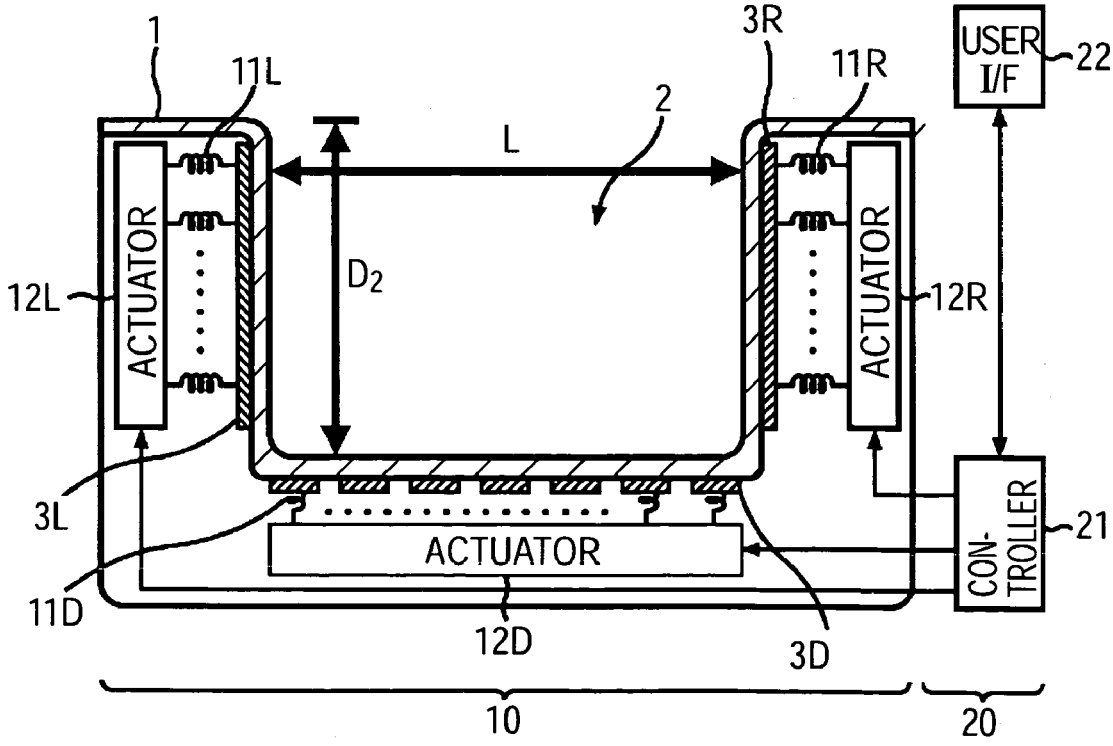
FIG. 6B is another sectional view of the bathtub 10, in which the shape of the tub 2 is changed in the depth direction, viewed from the front.

Next, FIGS. 6A and 6B show the bathtub 10 in a state of the tub 2 changed in depth D. FIGS. 6A and 6B are sectional views similar to FIG. 2.

When a pushing pressure is applied by the actuator 12D to the surface of the internal wall 1 supported by the support panel 3D, the surface having the pressure applied thereon move inside the bathtub 10, so that the depth D of the tub 2 is reduced as shown in FIG. 6A. In FIG. 6A, the depth D becomes D1.

When a drawing pressure is applied by the actuator 12D to the surface of the internal wall 1 supported by the support panel 3D, the surface having the pressure applied thereon move outside the bathtub 10, so that the depth D of the tub 2 is increased as shown in FIG. 6B. In FIG. 6B, the depth D becomes D2 (>D1).

Figure 7:
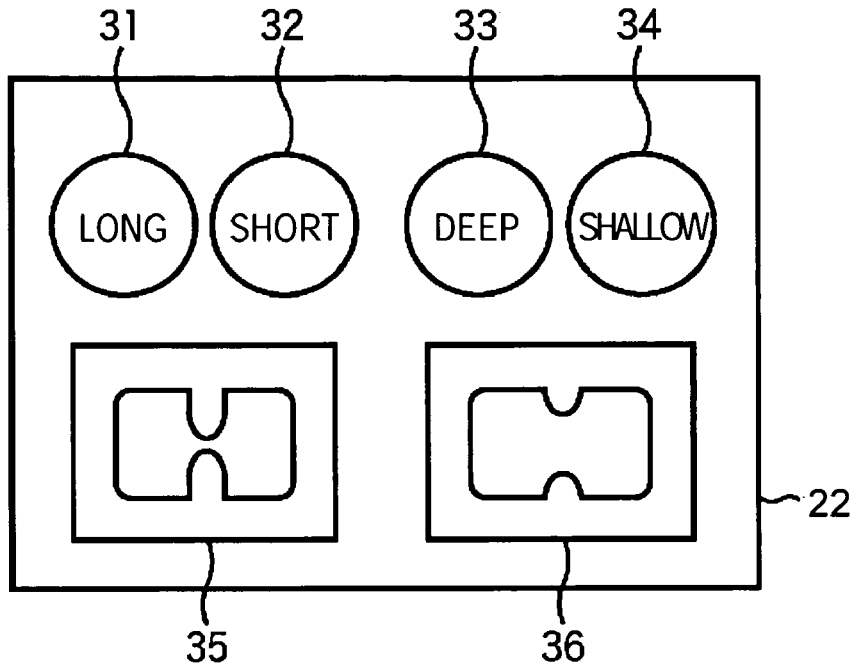
FIG. 7 is a plan view of a configuration of a user I/F 22.

Next, FIG. 7 is a plan view showing part of a configuration example of an operation unit of the user I/F 22 shown in FIGS. 2 and 3 operated by a user.

A button "long" 31 is pushed when the length L of the tub 2 is increased and a button "short" 32 is operated when the length L of the tub 2 is reduced.

A button "deep" 33 is pushed when the depth D of the tub 2 is increased and a button "shallow" 34 is operated when the depth D of the tub 2 is reduced.

A button "narrow" 35 is pushed when the width W of the tub 2 is reduced and a button "wide" 36 is operated when the width W of the tub 2 is increased.

Figure 8:
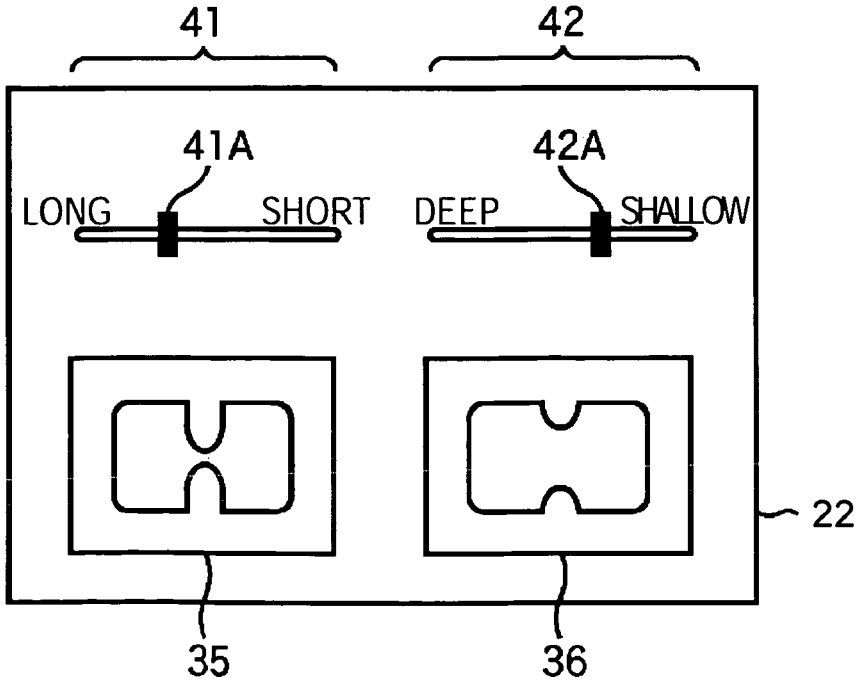
FIG. 8 is a plan view of another configuration of the user I/F 22.

Then, FIG. 8 is a plan view showing part of another configuration example of the operation unit of the user I/F 22 shown in FIGS. 2 and 3 operated by a user. In FIG. 8, like reference characters designate like parts common to FIG. 7, and the description thereof is appropriately omitted. That is, in the user I/F 22 of FIG. 8, instead of the button "long" 31 and the button "short" 32, a length slider 41 is provided while instead of the button "deep" 33 and the button "shallow" 34, a depth slider 42 is provided, and others are configured in the same way as those in FIG. 7.

The length slider 41 includes a knob 41A to be moved in the horizontal direction. When increasing the length L of the tub 2, the knob 41A is slid in the left, and conversely when reducing the length L, the knob 41A is slid in the right.

The depth slider 42 includes a knob 42A to be moved in the horizontal direction. When increasing the depth D of the tub 2, the knob 42A is slid in the left, and conversely when reducing the depth D, the knob 42A is slid in the right.

Figure 9:
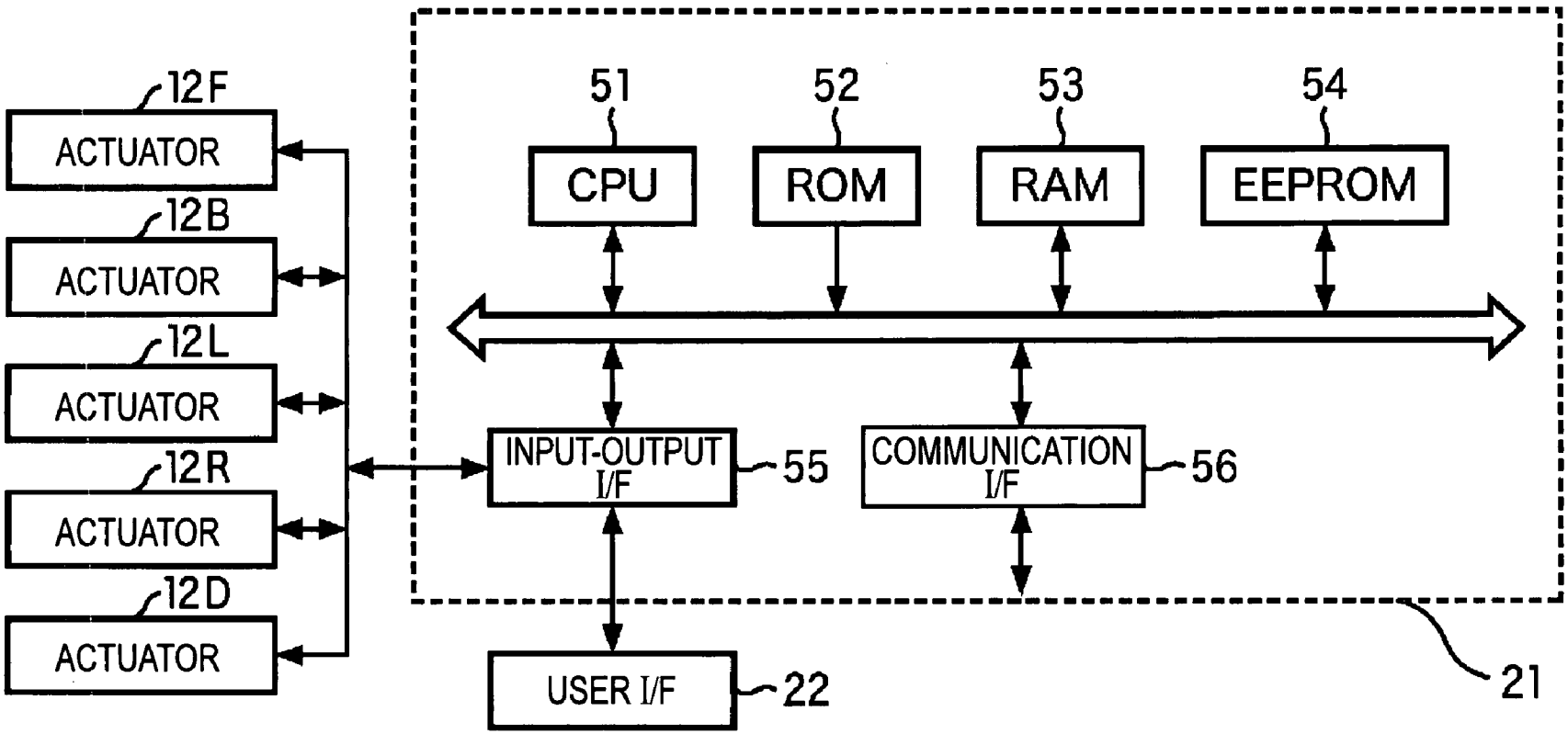
FIG. 9 is a block diagram showing a hardware configuration of a controller 21.

Next, FIG. 9 shows a configuration example of hardware of the controller 21 shown in FIGS. 2 and 3.

A CPU (central processing unit) 51 runs programs stored in an ROM (read only memory) 52 and an EEPROM (electrically erasable and programmable ROM) 54, or executes programs loaded in an RAM (random access memory) 53. The ROM 52 stores the programs to be executed at first by the CPU 51 and necessary data when electric power is supplied to the controller 21. The EEPROM 54 stores various application programs to be executed by the CPU 51 and necessary data. In the RAM 53, the application programs to be executed by the CPU 51 are loaded from the EEPROM 54, or data necessary for operation of the CPU 51 are stored. The EEPROM 54 stores the application programs to be executed by the CPU 51. The EEPROM 54 also stores data demanded to be held even after the power supply of the controller 21 is turned off.

An input-output I/F 55 receives an operation signal fed from the user I/F 22 by the operation of a user so as to supply it to the CPU 51. The input-output I/F 55 also feeds data to be displayed in the user I/F 22 to the user I/F 22. Furthermore, the input-output I/F 55 supplies control signals to the actuators 12F, 12B, 12L, 12R, and 12D so as to drive them. The input-output I/F 55 also receives drive amounts from the actuators 12F, 12B, 12L, 12R, and 12D so as to supply them to the CPU 51. The CPU 51 herein obtains the length L, the width W, and the depth D of the tub 2 at present based on the drive amounts from the actuators 12F, 12B, 12L, 12R, and 12D.

A communication I/F 56 controls the communication among networks, such as the Internet and a LAN (local area network), so as to send data to the networks and receive data therefrom.

In the controller 21 configured as described above, the CPU 51 executes the programs stored in the ROM 52 and the EEPROM 54 or the programs loaded in the RAM 53 so as to perform various processes including the below mentioned processes.

The programs to be executed by the CPU 51 can be installed in the ROM 52 and the EEPROM 54 in advance. The programs may also be stored temporarily or permanently in removable recording media, such as a flexible disc, a CD-ROM (compact disc read only memory), an MO (magneto optical) disk, a DVD (digital versatile disc), a magnetic disc, a semi-conductor memory, so as to provide them as so-called package software.

Furthermore, the programs may be wirelessly transferred to the controller 21 from a download site via an artificial satellite for a digital satellite broadcasting service, or they may be transferred to a partition W via a network, such as an LAN and the Internet, in a wired system. The controller 21 can receive the programs transferred in such a manner at the communication I/F 56 so as to install them into the EEPROM 54.

Figure 10:
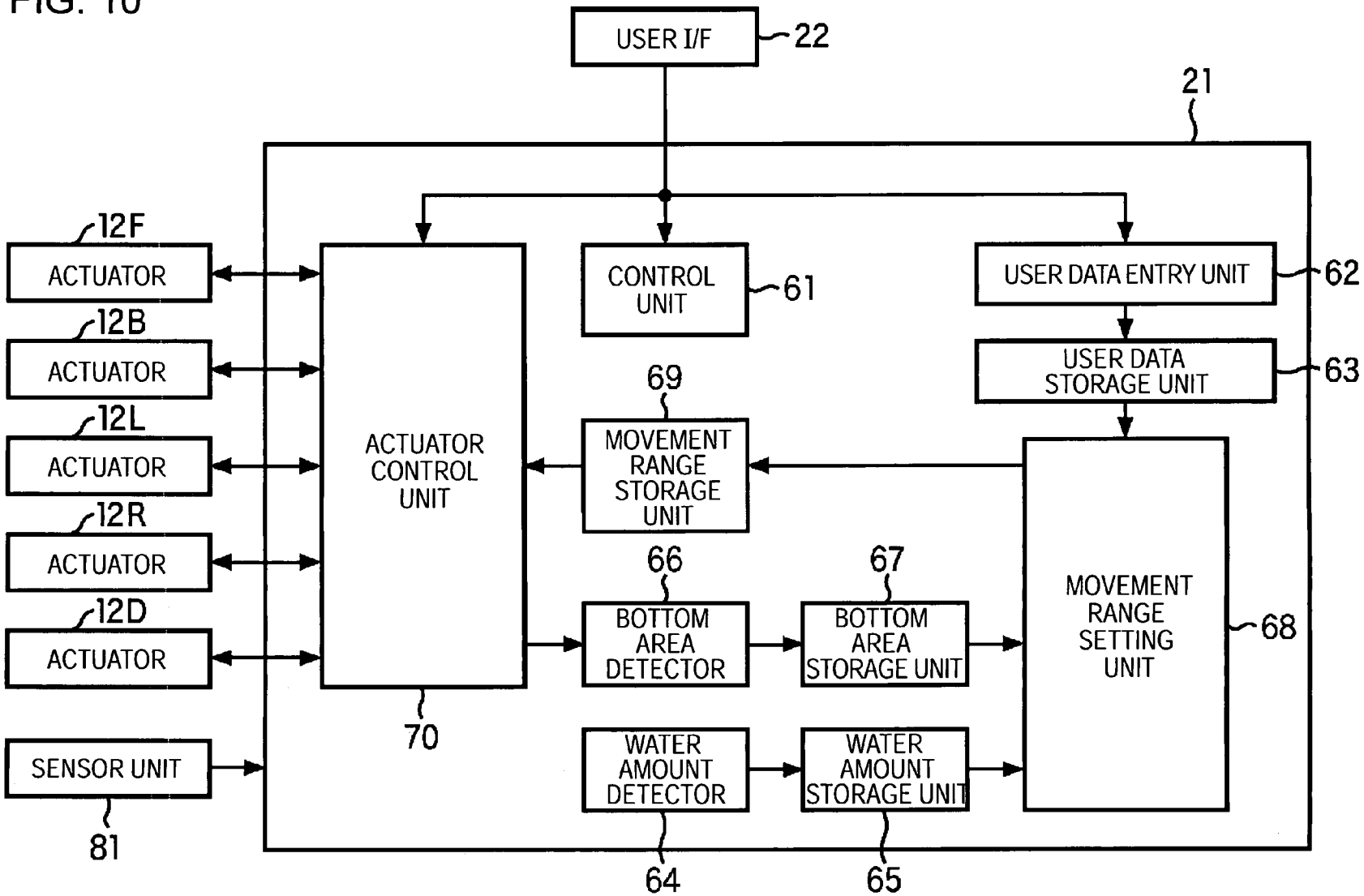
FIG. 10 is a block diagram showing a functional configuration of the controller 21.

Then, FIG. 10 shows a functional configuration example of the controller 21 shown in FIG. 9. The CPU 51 shown in FIG. 9 runs the programs so as to achieve the functional configuration in FIG. 10.

A control unit 61 controls the entire controller 21. For example, the control unit 61 turns on or off the power supply of the controller 21 corresponding to an operation signal fed from the user I/F 22.

A user data entry unit 62 feeds user data to a user data storage unit 63 based on an operation signal fed from the user I/F 22 so as to be stored therein. The user data storage unit 63 stores the user data supplied from the user data entry unit 62.

A water amount detector 64 detects an amount of hot water contained in the tub 2 so as to be stored in a water amount storage unit 65. The water amount storage unit 65 stores the water amount fed from the water amount detector 64.

A bottom area detector 66 detects the present bottom area of the tub 2 based on the information supplied from an actuator control unit 70 so as to feed it to a bottom area storage unit 67 to be stored. The bottom area storage unit 67 stores the bottom area fed from the bottom area detector 66.

A movement range setting unit 68 establishes a movement range of the shape of the tub 2 based on the user data stored in the user data storage unit 63, the water amount stored in the water amount storage unit 65, and the bottom area stored in the bottom area storage unit 67 so as to supply it to a movement range storage unit 69. That is, the movement range setting unit 68 establishes the respective upper limits and lower limits of the length L, the width W, and the depth D of the tub 2 as the movement ranges so as to feed them to the movement range storage unit 69. The movement range storage unit 69 stores the movement ranges fed from the movement range setting unit 68.

The actuator control unit 70 controls the actuators 12F, 12B, 12L, 12R, and 12D based on the operation signal from the user I/F 22 and the movement ranges stored in the movement range storage unit 69.

That is, the actuator control unit 70 controls the actuators 12F, 12B, 12L, 12R, and 12D so as to change the shape of the tub 2 within the movement ranges according to the operations of the button "long" 31, the button "short" 32, the button "deep" 33, the button "shallow" 34, the button "narrow" 35, and the button "wide" 36.

The actuator control unit 70 also receives drive amounts from the actuators 12F, 12B, 12L, 12R, and 12D so as to obtain the present length L, the width W, and the depth D of the tub 2 and feed them to the bottom area detector 66 if necessary.

A sensor unit 81 including sensors for sensing various pieces of information is provided in the bathtub 10 or a bathroom, where the bathtub 10 is arranged, for supplying the detected information to the controller 21.

Figure 11:
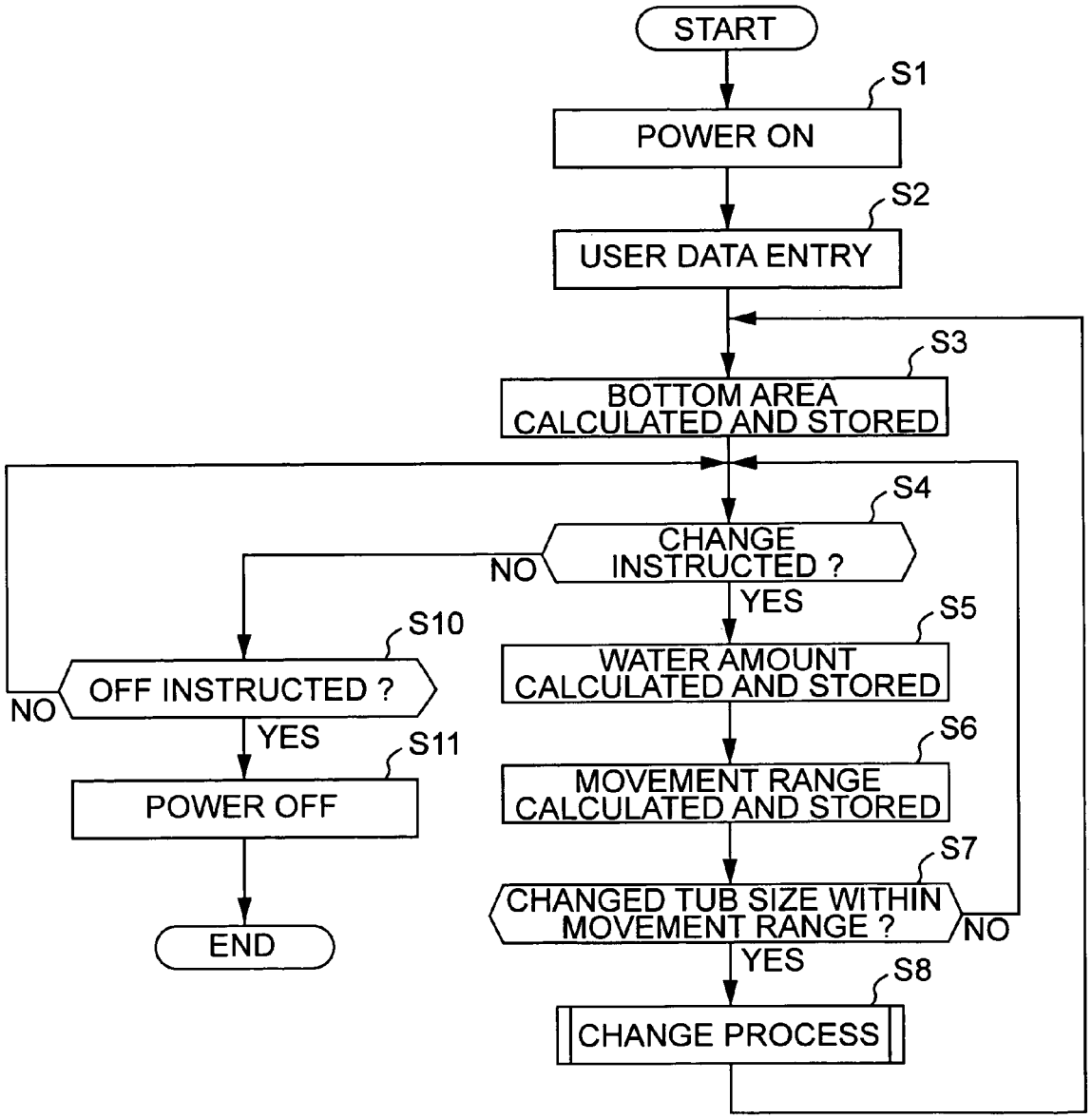
FIG. 11 is a flowchart illustrating the operation of the controller 21.

Then, the operation of the controller 21 shown in FIG. 10 will be described with reference to the flowchart of FIG. 11.

In addition, the tub 2 has already contained hot water with an appropriate temperature.

When a user who is going to take a bath turns the power supply of the controller 21 on by operating the user I/F 22, the user I/F 22 feeds an operation signal corresponding to the user operation, i.e., the operation signal instructing the power on, to the control unit 61.

Upon receiving the operation signal instructing the power on, at Step S1, the control unit 61 controls the power supply (not shown) to instruct each block constituting the controller 21 to start supplying electric power, and then the operation proceeds to Step S2.

At Step S2, the user data of the user who is going to take a bath are registered. Specifically, when the user inputs the own user data by operating the user I/F 22, the user data entry unit 62 obtains the user data from the user I/F 22 so as to be stored in the user data storage unit 63.

One or more of the body height, the shoulder width, the hip width, the seated height, the face length, the body volume, and the body weight of the user may be employed for the user data registered at Step S2.

The user data may also be obtained by sensing the user with the sensor unit 81 other than from the entry of the data by the user operating the user I/F 22.

Furthermore, when the user data have already been stored in the user data storage unit 63, the process at Step S2 can be skipped.

Also, when the user data of a plurality of users have already been stored with the user's names attached thereto in the user data storage unit 63, at Step S2, a list of the user's names is displayed on the user I/F 22 so as to allow the user to select the user's own name for making the user data corresponding to the selected name effective. In this case, the effective user data are used in the subsequent processes.

After the process at Step S2, the operation proceeds to Step S3, and the actuator control unit 70 obtains drive amounts from the actuators 12F, 12B, 12L, 12R, and 12D so as to have the present length L, the width W, and the depth D of the tub 2. Furthermore, at Step S3, the actuator control unit 70 feeds the length L and the width W among the present length L, the width W, and the depth D of the tub 2 to the bottom area detector 66. Then, the bottom area detector 66 obtains the present bottom area (L×W) using the length L and the width W from the actuator control unit 70 so as to be stored in the bottom area storage unit 67, and then the operation proceeds to Step S4.

At Step S4, the actuator control unit 70 determines whether the shape change of the tub 2 is instructed by a user operating the user I/F 22, i.e., operating the button "long" 31, the button "short" 32, the button "deep" 33, the button "shallow" 34, the button "narrow" 35, or the button "wide" 36 shown in FIG. 7.

When the shape change instruction of the tub 2 is determined at Step S4, i.e., when any one of the button "long" 31, the button "short" 32, the button "deep" 33, the button "shallow" 34, the button "narrow" 35, and the button "wide" 36 of the user I/F 22 (FIG. 7) is operated (pushed), so that an operation signal corresponding to the operation is fed from the user I/F 22 to the actuator control unit 70, the operation proceeds to Step S5, and the water amount detector 64 measures the amount of water contained in the tub 2 so as to be stored in the water amount storage unit 65.

When the sensor unit 81 includes a water amount sensor for sensing the water amount flowing from a tap to the tub 2, the water amount detector 64 can detect the amount of water contained in the tub 2 from the output of this water amount sensor.

When the sensor unit 81 includes a pressure sensor for sensing the pressure applied to the bottom surface of the tub 2, the water amount detector 64 may also obtain the water amount from the output of this pressure sensor and the bottom surface area of the tub 2 obtained from the bottom area detector 66. In this case, if the sensor unit 81 further includes a human sensor for sensing the presence of a human in the tub 2, the water amount in the tub 2 can be obtained by considering the presence of a human in the tub 2 which can be recognized from the output of the human sensor. That is, when a user is entering the tub 2, the water amount in the tub 2 can be obtained by excluding the pressure generated due to the body weight of the user from the output of the pressure sensor. In addition, the body weight of the user can be obtained from the user data stored in the user data storage unit 63.

After the process at Step S5, the operation proceeds to Step S6, and the movement range setting unit 68 establishes the respective upper limits and lower limits of the length L, the width W, and the depth D of the tub 2 as the movement ranges so as to be stored in the movement range storage unit 69, based on the user data stored in the user data storage unit 63, the water amount stored in the water amount storage unit 65, and the bottom surface area stored in the bottom area storage unit 67.

That is, the movement range setting unit 68 obtains the water level of the tub 2 when a user moves in the tub 2 by adding the water amount stored in the water amount storage unit 65 to the user body volume included in the user data stored in the user data storage unit 63 so as to divide the additional value by the bottom surface stored in the bottom area storage unit 67. When the sensor unit 81 includes a sensor for sensing the water level of the tub 2, the water level of the tub 2 when a user moves in the tub 2 can also be obtained using the output of this sensor.

The movement range setting unit 68 sets the lower limit of the depth D of the tub 2 at the same value as the water level of the tub 2 so that the hot water in the tub 2 does not spill over.

Furthermore, the movement range setting unit 68 obtains the difference between the seated height and the face length of a user included in the user data stored in the user data storage unit 63. Then, the movement range setting unit 68 sets the upper limit of the depth D of the tub 2 at the same value as the difference between the seated height and the face length of a user so that the face of the user within the tub 2 is exposed from the tub 2.

The movement range setting unit 68 also obtains the length L and the width W of the tub 2 suitable for a user from the user data stored in the user data storage unit 63 so as to establish the lower limits of the length L and the width W by subtracting predetermined margins from the suitable length L and width W, respectively, while establishing the upper limits of the length L and the width W by adding predetermined margins to the suitable length L and width W, respectively.

Then, the movement range setting unit 68 stores the respective upper limits and lower limits of the length L, the width W, and the depth D of the tub 2 established in such a manner as the movement ranges into the movement range storage unit 69.

Thereafter, the operation proceeds from Step S6 to Step S7, and when the actuator control unit 70 has changed the shape of the tub 2, i.e., the length L, the width W, or the depth D, by a predetermined unit quantity by following an operation signal instructing the change in shape of the tub 2, the actuator control unit 70 determines whether the shape of the tub 2 after the change falls within the movement range stored in the movement range storage unit 69.

At Step S7, if the shape of the tub 2 changed is determined to be within the movement range stored in the movement range storage unit 69, the operation proceeds to Step S8, and the actuator control unit 70 changes the shape of the tub 2, i.e., the length L, the width W, or the depth D, by a predetermined unit quantity in accordance with an operation signal from the user I/F 22, and then the operation returns to Step S3 so as to repeat the same processes.

At Step S7, if the shape of the tub 2 changed is determined to be out of the movement range stored in the movement range storage unit 69, that is, upon changing the length L, the width W, or the depth D by a predetermined unit quantity in accordance with an operation signal from the user I/F 22, if the length L, the width W, or the depth D changed is larger than the upper limit of the length L, the width W, or the depth D stored in the movement range storage unit 69, or if being smaller than the lower limit, the changing process at Step S8 is skipped so that the operation returns to Step S4 so as to repeat the same processes.

Accordingly, as long as a user continues to operate any one of the button "long" 31, the button "short" 32, the button "deep" 33, the button "shallow" 34, the button "narrow" 35, and the button "wide" 36 of the user I/F 22 (FIG. 7) and an operation signal corresponding to this operation is fed to the actuator control unit 70, the actuator control unit 70 continues to perform the changing process (Step S8) for changing the changing the shape of the tub 2 within the movement range.

On the other hand, if the change in shape of the tub 2 is determined to be not instructed at Step S4, the operation proceeds to Step S10, and the control unit 61 determines whether the power off is instructed by a user operating the user I/F 22.

If the power off is determined to be not instructed at Step S10, the operation returns to Step S4 so as to repeat the same processes.

If the power off is determined to be instructed at Step S10, i.e., if a user operates the user I/F 22 to turn off the power so that an operation signal corresponding to this operation is fed from the user I/F 22 to the control unit 61, the operation proceeds to Step S11, and the control unit 61 controls the power supply (not shown) to stop supplying electric power to each block constituting the controller 21 so as to complete the processes.

Next, the changing process at Step S8 of FIG. 11 will be described with reference to the flowchart of FIG. 12.

In the changing process, first at Step S21, the actuator control unit 70 determines in which direction among the length L, the width W, and the depth D of the tub 2, the operation signal from the user I/F 22 instructs to change the size of the tub 2.

If the operation signal from the user I/F 22 is determined to instruct the size change in the direction of the length L of the tub 2 at Step S21, the operation proceeds to Step S22, and the actuator control unit 70 determines whether the operation signal from the user I/F 22 instructs to increase the length L of the tub 2 or to reduce it.

If the operation signal from the user I/F 22 is determined to instruct increasing the length L of the tub 2 at Step S22, i.e., if a user operates the button "long" 31 of the user I/F 22 (FIG. 7), the operation proceeds to Step S23, and the actuator control unit 70 controls any one of the actuators 12L and 12R or both of them to apply drawing pressure, and returns. A pressure is thereby applied on a surface of the internal wall 1, so that as shown in FIG. 4B, the surface of the internal wall 1 having the pressure applied thereon moves outward the bathtub 10, increasing the length L of the tub 2 by a predetermined unit quantity.

If the operation signal from the user I/F 22 is determined to instruct reducing the length L of the tub 2 at Step S22, i.e., if a user operates the button "short" 32 of the user I/F 22 (FIG. 7), the operation proceeds to Step S24, and the actuator control unit 70 controls any one of the actuators 12L and 12R or both of them to apply pushing pressure, and returns. A pressure is thereby applied on a surface of the internal wall 1, so that as shown in FIG. 4A, the surface of the internal wall 1 having the pressure applied thereon moves inward the bathtub 10, reducing the length L of the tub 2 by a predetermined unit quantity.

On the other hand, if the operation signal from the user I/F 22 is determined to instruct the size change in the direction of the width W of the tub 2 at Step S21, the operation proceeds to Step S25, and the actuator control unit 70 determines whether the operation signal from the user I/F 22 instructs to increase the width W of the tub 2 or to reduce it.

If the operation signal from the user I/F 22 is determined to instruct increasing the width W of the tub 2 at Step S25, i.e., if a user operates the button "wide" 36 of the user I/F 22 (FIG. 7), the operation proceeds to Step S26, and the actuator control unit 70 controls any one of the actuators 12F and 12B or both of them to apply drawing pressure, and returns. A pressure is thereby applied on a surface of the internal wall 1, so that as shown in FIG. 5B, the surface of the internal wall 1 having the pressure applied thereon moves outward the bathtub 10, increasing the width W of the tub 2 by a predetermined unit quantity.

If the operation signal from the user I/F 22 is determined to instruct reducing the width W of the tub 2 at Step S25, i.e., if a user operates the button "narrow" 35 of the user I/F 22 (FIG. 7), the operation proceeds to Step S27, and the actuator control unit 70 controls any one of the actuators 12F and 12B or both of them to apply pushing pressure, and returns. A pressure is thereby applied on a surface of the internal wall 1, so that as shown in FIG. 5A, the surface of the internal wall 1 having the pressure applied thereon moves inward the bathtub 10, reducing the width W of the tub 2 by a predetermined unit quantity.

On the other hand, if the operation signal from the user I/F 22 is determined to instruct the size change in the direction of the depth D of the tub 2 at Step S21, the operation proceeds to Step S28, and the actuator control unit 70 determines whether the operation signal from the user I/F 22 instructs to increase the depth D of the tub 2 or to reduce it.

If the operation signal from the user I/F 22 is determined to instruct increasing the depth D of the tub 2 at Step S28, i.e., if a user operates the button "deep" 33 of the user I/F 22 (FIG. 7), the operation proceeds to Step S29, and the actuator control unit 70 controls the actuator 12D to apply drawing pressure, and returns. A pressure is thereby applied on a surface of the internal wall 1, so that as shown in FIG. 6B, the surface of the internal wall 1 having the pressure applied thereon moves outward the bathtub 10, increasing the depth D of the tub 2 by a predetermined unit quantity.

If the operation signal from the user I/F 22 is determined to instruct reducing the depth D of the tub 2 at Step S28, i.e., if a user operates the button "shallow" 34 of the user I/F 22 (FIG. 7), the operation proceeds to Step S30, and the actuator control unit 70 controls the actuator 12D to apply pushing pressure, and returns. A pressure is thereby applied on a surface of the internal wall 1, so that as shown in FIG. 6A, the surface of the internal wall 1 having the pressure applied thereon moves inward the bathtub 10, reducing the depth D of the tub 2 by a predetermined unit quantity.

As described above, based on an operation entry from a user and the movement range, the actuators 12L, 12R, 12D, 12F, and 12B are controlled for applying pressure on the internal wall 1 made of a flexible material, and the shape of the tub 2 can be changed within the movement range by enhancing a user's will that is a demand for changing the bathtub shape, which is recognized by the operation entry by the user, so that the user can have a comfortable bath by changing the tub 2 in a favorite shape.

Figure 12:
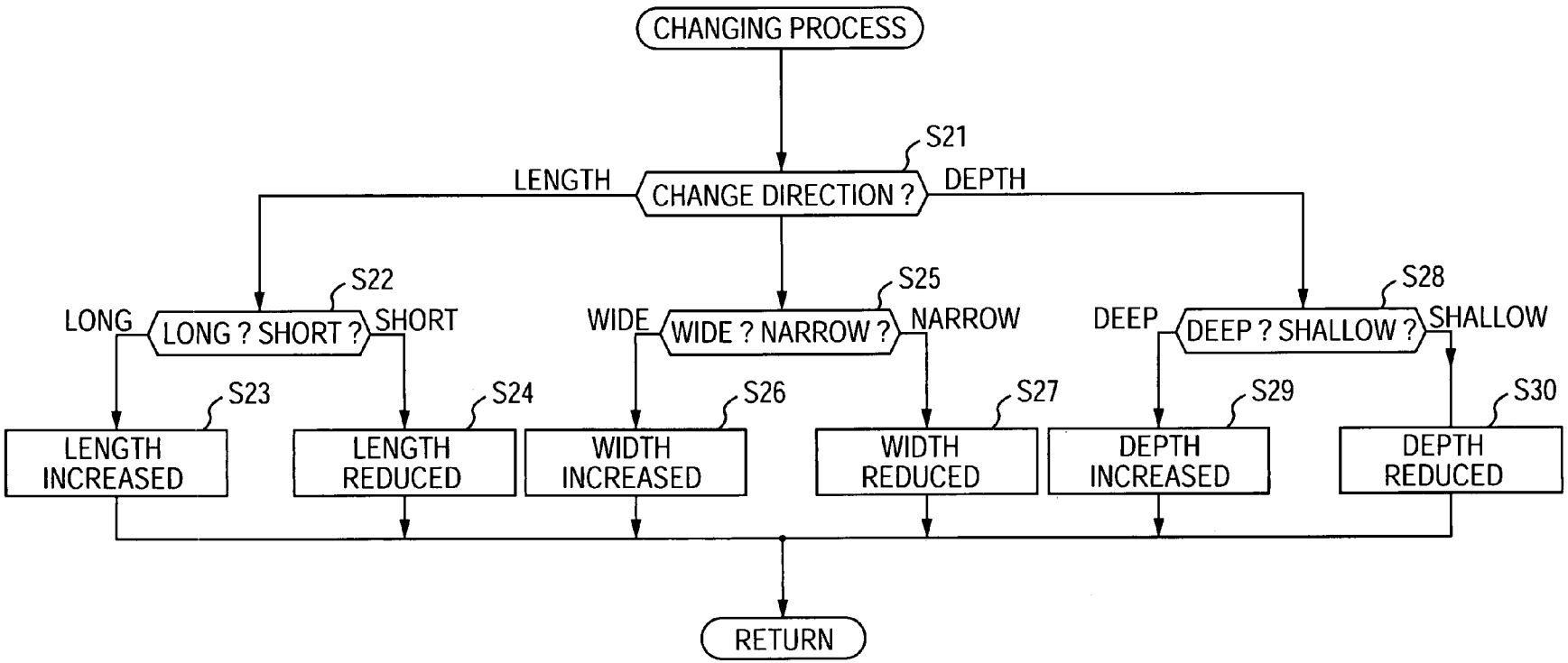
FIG. 12 is a flowchart illustrating a changing process.

As described above with reference to FIG. 11, after the changing process at Step S8 following the flowchart of FIG. 12, the operation returns to Step S3 and the bottom surface area of the tub 2 is calculated; however, if the depth D is changed in the changing process at Step S8, the bottom surface area of the tub 2 is not changed, so that the process at Step S3 can be skipped.

The internal wall 1 may be entirely made of a flexible material; alternatively, only corner portions (vicinities of sides of the parallelepiped tub) may be made of the flexible material.

Furthermore, according to the embodiment, the entire front, rear, left side, right side, and bottom surfaces of the tub 2 surrounded with the internal wall 1 can be moved; however, only any one or more surfaces of the entire front, rear, left side, right side, and bottom surfaces of the tub 2 surrounded with the internal wall 1 may also be moved.

The present application contains subject matter related to Japanese patent application No. JP 2004-294176, filed in the JPO on Oct. 6, 2004, the entire contents of which being incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A bathtub device comprising:

an internal wall made of a flexible material, the internal wall is shaped as a concave tub and is configured to hold water and a user submersed in the water, the internal wall including a front surface, a rear surface, a right surface, a left surface, and a bottom surface;

a pressure unit configured to change a shape of the internal wall by applying a pressure on the internal wall;

a setting unit configured to set a movement range for the shape of the internal wall; and a pressure control unit configured to control the pressure unit based on an operation entry by a user and the movement range, wherein the pressure control unit is configured to change the shape of the internal wall in length, width or depth directions within the movement range for the shape of the internal wall by controlling the pressure unit to apply a pressure independently to each of the front, rear, right, left, or bottom surface of the internal wall.

2. The device according to claim 1, further comprising:

a bottom surface area detector configured to detect the bottom surface area of the internal wall; and a water amount detector configured to detect the water amount contained in the internal wall based on the bottom surface area of the internal wall, wherein the setting unit sets the movement range on the basis of the bottom surface area of the internal wall and the water amount contained in the internal wall.

3. The device according to claim 2, wherein the pressure control unit comprises:

a plurality of front panels configured to apply a front pressure on the front surface to move the front surface;

a plurality of rear panels configured to apply a rear pressure on the rear surface to move the rear surface;

a plurality of right panels configured to apply a right pressure on the right surface to move the right surface;

a plurality of left panels configured to apply a left pressure on the left surface to move the left surface;

a plurality of bottom panels configured to apply a bottom pressure on the bottom surface to move the bottom surface; and wherein the internal wall is configured to maintain a rectangular parallelpiped shape when moved by the front, rear, left, right, or bottom pressures.

4. The device according to claim 3, wherein each of the panels in the plurality of front, rear, right, left, and bottom panels is shaped substantially as a rectangular flat plate.

5. The device according to claim 4, wherein the setting unit includes:

a length slider configured to adjust the length of the internal wall, a depth slider configured to adjust the depth of the internal wall, a narrow button configured to narrow the internal wall when depressed, and a wide button configured to widen the internal wall when depressed.

6. The device according to claim 1, wherein the pressure control unit changes the shape of the internal wall within the movement range of the internal wall by controlling the pressure unit to apply a pressure on the internal wall as long as the operation entry by a user continues.

7. The device according to claim 1, wherein the setting unit sets the movement range on the basis of one or more of a body height, a shoulder width a hip width, a seated height, a face length, a body volume, and a body weight of a user.

8. A bathtub device comprising:

an internal wall shaped as a concave tub and made of a flexible material, the internal wall having a horizontal surface and a plurality of side surfaces;

a pressurizing means for changing a shape of the internal wall by applying a pressure on a surface of the internal wall;

a setting means for setting a movement range that is a changeable range of the shape of the internal wall; and a pressure controlling means for controlling the pressurizing means based on an operation entry by a user and the movement range, enabling each surface of the internal wall to be moved independently.

9. An adjustable bathtub device, comprising:

a tub wall made of a flexible material, the tub wall having a shape of a concave receptacle, the tub wall having a concavity side and on the opposite side of the tub wall a non-concavity side, the tub wall having a plurality of support surfaces configured to hold water and to hold a user at least partially submerged in the water, the non-concavity side is not configured to contact the water, the plurality of support surfaces includes a plurality of substantially vertical surfaces and a bottom surface, the concave receptacle having a plurality of dimensions, including a bottom surface length, a bottom surface width, and a height of the vertical surfaces;

an actuator system configured to independently move each of the plurality of support surfaces and thereby change at least one of the plurality of dimensions; and a control system having a processor configured to instruct the actuator system to independently move each of the plurality of support surfaces, the control system configured to accept instructions from the user to change at least one of the plurality of dimensions, the control system configured to keep the plurality of dimensions within an acceptable set of values.

10. The adjustable bathtub device of claim 9, wherein:

the plurality of substantially vertical support surfaces includes a front surface, rear surface, right surface, and left surface;

the front and rear surfaces are parallel and separated by a length;

the right and left surfaces are parallel and separated by a width;

the bottom surface is substantially orthogonal to the front, rear, right, and left surfaces;

the bottom surface is substantially horizontal and configured to move up and down vertically;

a maximum height of a maximum amount of water to be held in the tub wall without overflowing is an overflow height; and the plurality of dimensions include the length, the width, and the overflow height.

11. The adjustable bathtub device of claim 10, wherein the control system is configured to establish the acceptable set of values based on one or more of a body height, a shoulder width, a seated height, a face length, a body volume, and a body weight of the user.

12. The adjustable bathtub device of claim 11, wherein the front, rear, right, left, and bottom surfaces are disposed as sides of a rectangular parallelpiped.

13. The adjustable bathtub device of claim 12, further comprising:

a wall sensing device configured to measure the length, the width, and the overflow height;

a water sensing device configured measure the amount of water; and the wall and water sensing devices configured to convey the measurements to the control system.

14. The adjustable bathtub device of claim 9, wherein the actuator system includes:

one or more panels attached to the non-concavity side of each one of the plurality of support surfaces that the actuator system is capable of moving, wherein each of the one or more panels is attached to an actuator via an elastic cushioning unit, the elastic cushioning unit is configured to transfer a pressure from the actuator to one of the plurality of support surfaces.

15. The adjustable bathtub device of claim 14, wherein the actuator includes a motor that is configured to apply a pushing pressure on the elastic cushioning unit towards one of the plurality of support surfaces when instructed by the control system, and the motor is configured to apply a drawing pressure on the elastic cushioning unit away from one of the plurality of support surfaces when instructed by the control system.

* * * * *